US005235835A

United States Patent [19]

Sakai et al.

[11] Patent Number: 5,235,835

[45] Date of Patent: Aug. 17, 1993

[54] METHOD AND APPARATUS FOR CONTROLLING FLATNESS OF STRIP IN A ROLLING MILL USING FUZZY REASONING

[75] Inventors: Toshio Sakai, Oyama; Hideki Maeda, Fukui; Hiroshi Nagakura, Fukui; Shigeru Hishikawa, Fukui, all of Japan

[73] Assignees: Furukawa Aluminum Co., Ltd; Hitachi Ltd., both of Tokyo, Japan

[21] Appl. No.: 815

[22] Filed: Jan. 5, 1993

Related U.S. Application Data

[63] Continuation-in-part of Ser. No. 807,782, Dec. 11, 1991, which is a continuation of Ser. No. 459,003, Dec. 29, 1989, abandoned.

[51] Int. Cl.[5] ..... B21B 37/00; B21B 27/06

[52] U.S. Cl. ..... 72/10; 72/201

[58] Field of Search ..... 72/12, 9, 17, 8, 10, 72/200, 201; 395/3, 61; 364/148, 152, 153, 157, 158, 160, 161, 162, 472

[56] References Cited

U.S. PATENT DOCUMENTS

| | | | |
|---|---|---|---|
| 3,334,508 | 8/1967 | Martin | 72/12 |
| 4,262,511 | 4/1981 | Boisvert et al. | 72/201 |
| 4,400,957 | 8/1983 | Carlstedt et al. | 72/12 |
| 4,537,050 | 8/1985 | Bryant et al. | 72/12 |
| 4,587,819 | 5/1986 | Hausen | 72/9 |
| 4,633,693 | 1/1987 | Tahara et al. | 72/201 |
| 4,777,585 | 10/1988 | Kokawa et al. | 395/61 |
| 4,903,192 | 2/1990 | Saito et al. | 364/157 |
| 5,043,862 | 8/1991 | Takahaski et al. | 364/162 |

FOREIGN PATENT DOCUMENTS

| | | | |
|---|---|---|---|
| 0195522 | 12/1982 | Japan | 72/12 |
| 0065507 | 4/1983 | Japan | 72/9 |
| 0171209 | 7/1988 | Japan | 72/200 |
| 1088408 | 8/1988 | Japan | 72/200 |
| 2119968 | 11/1983 | United Kingdom | 72/9 |

OTHER PUBLICATIONS

Gupta et al., "Intrinsic Fuzzy Electronic Crcuits for Sixth Generation Comp.", 1988.

Mamdani, "Application of Fuzzy Alyorithms for Control of Simple Dynamic Plant", IEEE, vol. 121, No. 12, Dec. 1974.

*Primary Examiner*—Lowell A. Larson

*Assistant Examiner*—Michael J. McKeon

*Attorney, Agent, or Firm*—Pearne, Gordon, McCoy & Granger

[57] ABSTRACT

A rolling mill comprising an actuator for controlling shapes or conditions of work roll surfaces during rolling and a flatness meter for detecting broadwise flatness of rolled strip to generate an output signal whereby the actuator is operated so as to control the flatness of strip, the output signal being analyzed into a plurality of evaluation indexes. Each of the evaluation indexes is converted by a membership function into a fuzzy quantity having one of a predetermined number of values. These fuzzy quantities are subjected to fuzzy reasoning consisting of a plurality of control rules to set the control value of the actuator.

20 Claims, 6 Drawing Sheets

METHOD AND APPARATUS FOR CONTROLLING FLATNESS OF STRIP IN A ROLLING MILL USING FUZZY REASONING

This is a continuation-in-part of application Ser. No. 07/807,782, filed Dec. 11, 1991, which was a continuation of Ser. No. 07/459,003, filed Dec. 29, 1989, now abandoned.

BACKGROUND OF THE INVENTION

In general, automatic flatness control for a rolling mill comprises roll cooling means including a plurality of coolant spray nozzles disposed side by side in a longitudinal direction of work rolls for controlling shapes or conditions of the work roll surfaces during rolling and a flatness meter for detecting broadwise flatness of rolled strip to generate an output signal to operate the roll cooling means. The coolant spray nozzles are independently controlled in accordance with the output signal from the flatness meter whereby thermal crown of the work rolls is adjusted so that the flatness of strip is properly controlled.

In one of the prior art references, in case a strip portion or portions are judged by the output signal from the flatness meter to have localized high tension in a longitudinal direction of the work rolls which corresponds to a broadwise direction of the strip, roll coolant stops being sprayed corresponding to the strip portion or portions while, in case another strip portion or other strip portions are judged to have low tension due to their elongation, roll coolant is sprayed onto the strip portion or portions. This is accomplished by on-off control of the coolant spray nozzles.

In another prior art reference, a flow amount of roll coolant is successively adjusted by coolant flow adjusting valves provided corresponding to the respective coolant spray nozzles so that the thermal crown is controlled.

However, in the prior art references, since the roll coolant is controlled in accordance with only the output signal from the flatness meter, it is made without any variation in control along the longitudinal direction of the work rolls, with the result that any control cannot be made so as to generate no localized buckle such as quarter buckle due to thermal crown. Furthermore, since there is no control logic to compensate for variation ratio of flatness in a direction in which flatness varies, there often occurs overshoot and, therefore, the flatness of the strip cannot be controlled with precision.

SUMMARY OF THE INVENTION

Accordingly, it is a principal object of the invention to provide a method of controlling flatness of strip by a rolling mill in which the flatness of the strip can be effectively controlled in accordance with rolling conditions varying without any complicated calculation.

It is another object of the invention to provide automatic flatness control for a rolling mill adapted to control flatness of strip by the rolling mill in which the strip can be effectively controlled in accordance with rolling conditions varying without any complicated calculation.

In accordance with one aspect of the present invention, there is provided a method of controlling flatness of strip by a rolling mill comprising an actuator for controlling shapes or conditions of work roll surfaces during rolling and a flatness meter for detecting broadwise flatness of rolled strip to generate an output signal whereby said actuator is operated so as to control the flatness of said strip, said method characterized in that said output signal is analyzed into a plurality of evaluation indexes so as to determine them as fuzzy quantities whereby a control output for said actuator is set by fuzzy reasoning so as to properly control said flatness of said strip.

In accordance with another aspect of the present invention, there is provided an apparatus for controlling flatness of strip by a rolling mill comprising an actuator for controlling shapes or conditions of work roll surfaces during rolling and a flatness meter for detecting broadwise flatness of rolled strip to generate an output signal whereby said actuator is operated so as to control the flatness of said strip, said apparatus characterized by further comprising fuzzy reasoning means to analyze said output signal into a plurality of evaluation indexes so as to determine them as fuzzy quantities whereby a control output for said actuator is set by fuzzy reasoning so as to properly control the flatness of said strip.

BRIEF DESCRIPTION OF THE DRAWINGS

The above and other objects and features of the invention will be apparent from the description of the embodiments of the invention with reference to the accompanying drawings in which.

DESCRIPTION OF THE PREFERRED EMBODIMENTS

Figure 1:
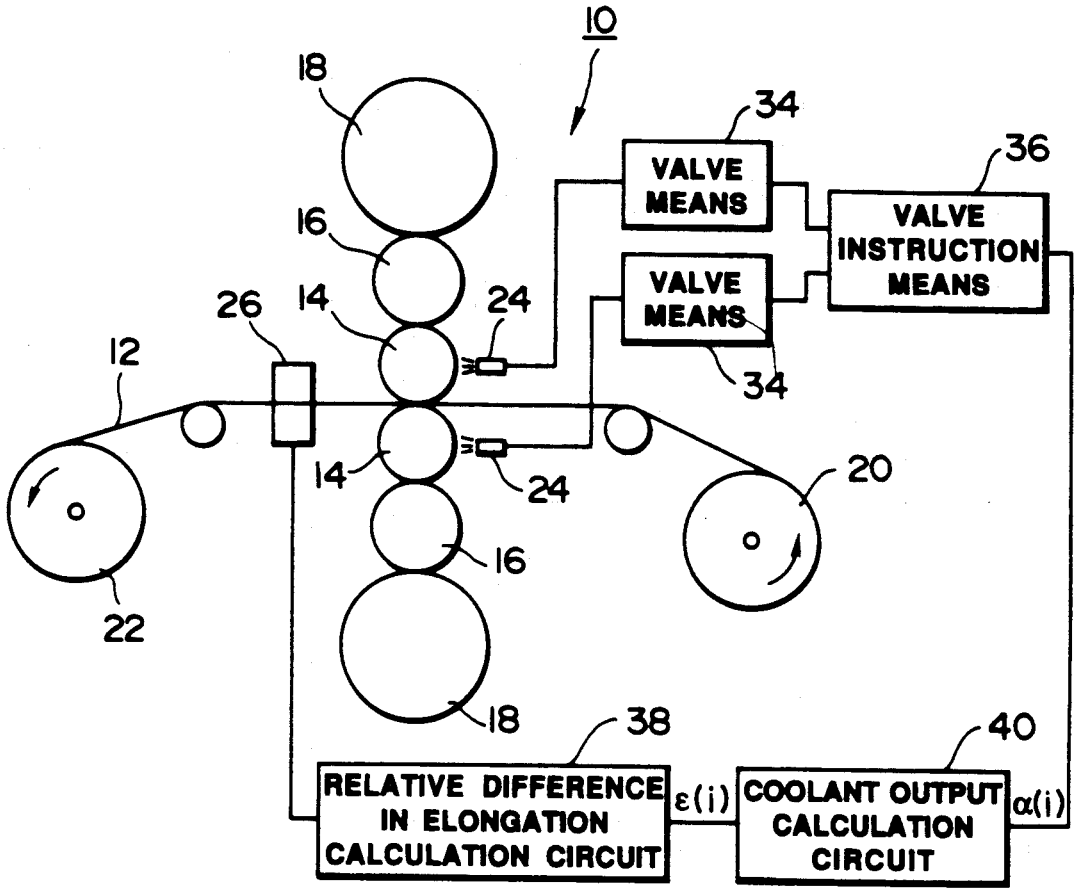
FIG. 1 is a schematic diagram of an apparatus used for a method of controlling flatness of strip in accordance with one embodiment of the invention.

Referring now to FIG. 1, there is shown an apparatus for controlling flatness of strip by a rolling mill in accordance with one embodiment of the invention.

The rolling mill 10 comprises upper and lower work rolls 14 and 14 for rolling strip 12, intermediate rolls 16 and 16, and back up rolls 18 and 18. The strip 12 passes from a pay off reel 20 through the gap between the work rolls 14 and 14 and is wound on a tension reel 22.

Figure 2:
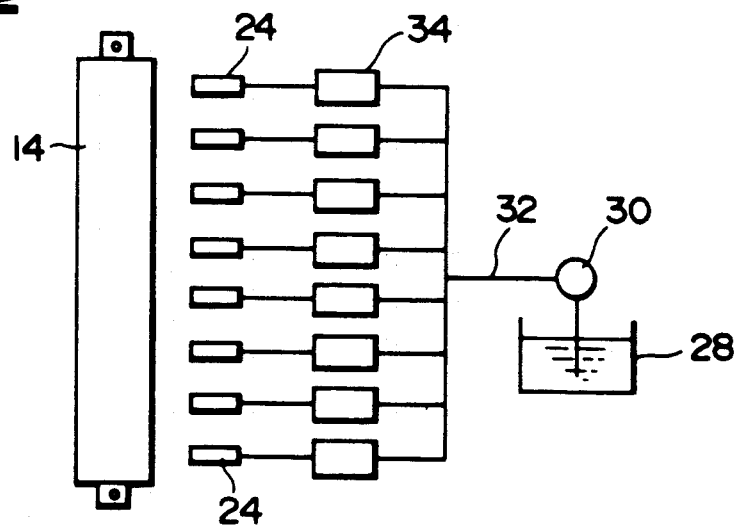
FIG. 2 is a schematic diagram of a roll cooling system used for the apparatus of FIG. 1.

The rolling mill 10 also comprises outer roll cooling means including a plurality of coolant spray nozzles 24 disposed side by side in a longitudinal direction of work rolls 14 for controlling shapes or conditions of work roll surfaces and serving as an actuator for controlling the shapes or conditions of the work roll surfaces during rolling and a flatness meter 26 for detecting broadwise flatness of the rolled strip 12 to generate an output signal. As shown in FIG. 2, roll coolant is supplied to the respective coolant spray nozzles 24 from a coolant tank 28 through a supply pump 30, a main conduit 32 and respective valve means 34. A control instruction is fed to the respective valve means 34 from a valve instruction means 36 which receives coolant output signals calculated in accordance with the method of the invention.

The flatness meter 26 supplies the output signal corresponding to the detected flatness of the strip 12 to a relative difference in elongation calculation circuit 38 which serves to convert the output signal (flatness signal) from the flatness meter 26 into a relative difference in elongation $\epsilon(i)$. It should be noted that a symbol "(i)" of the relative difference in elongation $\epsilon(i)$ is an index indicating the longitudinal position of the work rolls corresponding to the respective coolant spray nozzles 24.

A coolant output calculation circuit 40 serves to analyze a deviation signal between the output signal from the flatness meter 26 and an objective flatness set value into a plurality of evaluation indexes so as to determine them as fuzzy quantities whereby a spray amount of the respective coolant spray nozzles 24 is set by fuzzy reasoning and fed to the valve instrucion means 36 so as to properly control the flatness of the strip 12, as hereafter described. In the illustrated embodiment, the coolant output calculation circuit 40 receives the relative difference in elongation $\epsilon(i)$ which is the output from the relative difference in elongation calculation circuit 38 to determine a coolant output $\alpha(i)$ as described hereinjustbelow.

Figure 3A:
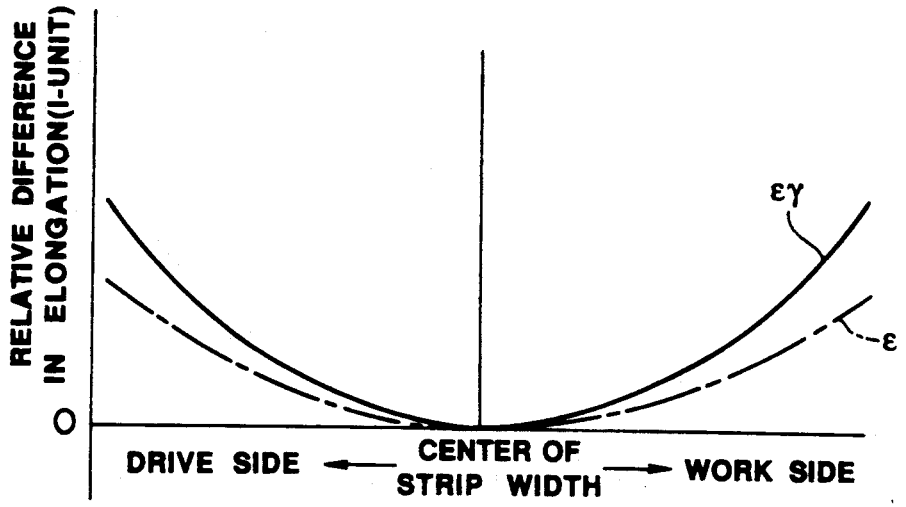
FIG. 3A illustrates curves indicating objective flatness and actual flatness of the strip.
Figure 3B:
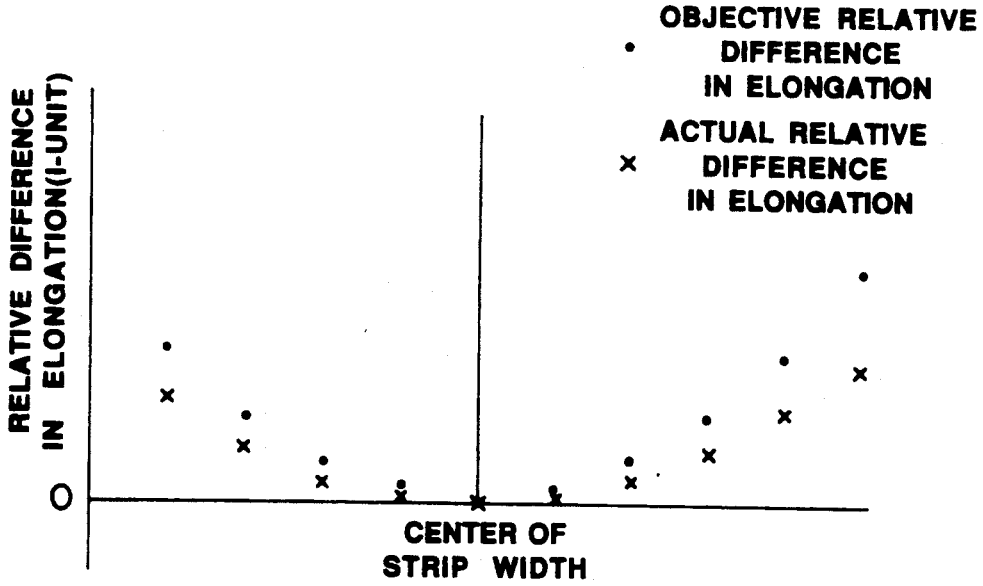
FIG. 3B illustrates distribution of objective values and actual values of relative difference in elongation.

FIG. 3A indicates an objective flatness and actual flatness of the rolled strip 12. In FIG. 3A, a solid line indicates the objective flatness (objective relative difference in elongation) $\epsilon\gamma$ as expressed by a quadratic function in case a center of the strip 12 is supposed to be zero while a dotted chain line of FIG. 3A indicates an example of the flatness of the strip (actual relative difference in elongation) $\epsilon$ in case a center of the strip 12 is supposed to be zero. FIG. 3B indicates a distribution of the objective relative differences in elongation $\epsilon\gamma(i)$ and the actual relative differences in elongation $\epsilon(i)$ in case the strip 12 is divided into a plurality of zones corresponding to the divided widths of the flatness meter 26. It should be noted that the following three evaluation values can be determined from the objective relative differences in elongation $\epsilon\gamma(i)$ and the actual relative differences in elongation $\epsilon(i)$.

(1) Control deviation A(i)

This is evaluated by a difference between the objective relative differences in elongation $\epsilon\gamma(i)$ and the actual relative differences in elongation $\epsilon(i)$ as expressed by the following;

$$A(i)=\epsilon(i)-\epsilon\gamma(i) \quad (1)$$

(2) Flatness variation ratio B(i)

This is evaluated as variation ratio (variation direction) of actual relative differences in elongation $\epsilon(i)$ as expressed by the following;

$$B(i)=d\epsilon(i)/dt \quad (2)$$

(3) Localized buckle evaluation index C(i)

This is an evaluation of localized buckle portions due to thermal crown as expressed by the following;

$$C(i)=\epsilon(i)-\{(\epsilon(i-1)+\epsilon(i+1))/2\} \quad (3)$$

wherein a symbol (i+1) indicates a position next to one longitudinal position (i) of the work rolls while a symbol (i−1) indicates a position reversely next to the position (i).

The control output is determined by fuzzy reasoning from the aforementioned evaluation indexes. The reasoning rules are as follows;

(1) If the control deviation A(i) is slightly minus, the flatness variation ratio B(i) slightly increases in a plus direction and the localized buckle evaluation index C(i) is zero, then the coolant output $\alpha(i)$ is kept at the present value.

(2) If the control deviation A(i) is zero, the flatness variation ratio B(i) largely decreases in a minus direction and the localized buckle evaluation index C(i) is slightly larger, then the coolant output $\alpha$ (i) slightly decreases.

(3) If the control deviation A(i) is slightly plus, the flatness variation ratio B(i) is zero and the localized buckle evaluation index C(i) is much larger, then the coolant output $\alpha(i)$ largely increases.

(4) The rest is omitted.

Figure 4A:
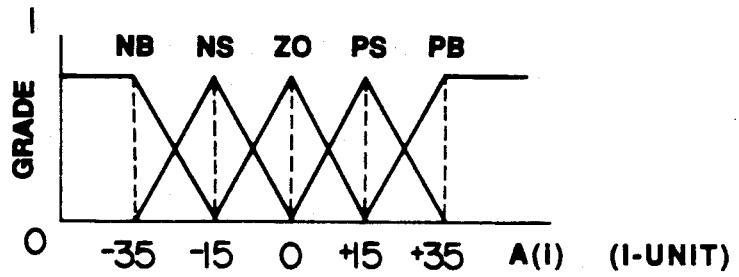
FIGS. 4A through 4C illustrate membership functions of fuzzy variables.
Figure 4B:
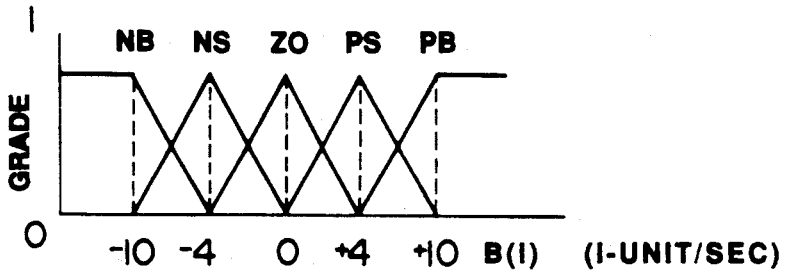
Figure 4C:
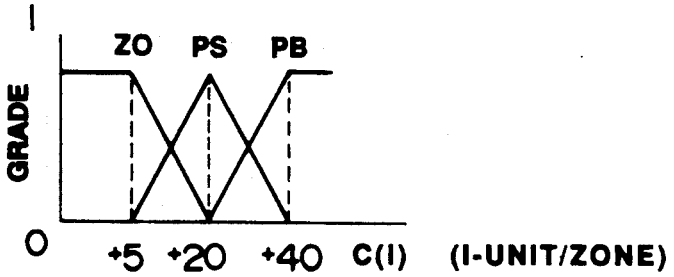

Although the three evaluation indexes such as A(i), B(i) and C(i) necessary for determining the coolant output $\alpha(i)$ which is the control output by fuzzy reasoning are defined by using the membership function, and establishing A(i), B(i) and C(i) as fuzzy quantities, an example thereof is shown in FIGS. 4A through 4C.

FIG. 4A indicates a membership function of fuzzy variable of the deviation A(i), FIG. 4B indicates a membership function of fuzzy variable of the variation ratio B(i) and FIG. 4C indicates a membership function of fuzzy variable of the localized buckle evaluation index C(i). Therefore, the quantities A(i), B(i) and C(i) are each transformed by the membership function from their numeric values to one of the five values PB, PS, ZO, NS or NB. In these figures, "PB" is an abbreviation of "Positive Big" which means a mass of positive and big numbers, "PS" is an abbreviation of "Positive Small" which means a mass of positive and small numbers, "ZO" is an abbreviation of "Zero", "NS" is an abbreviation of "Negative Small" which means a mass of negative and small numbers, and "NB" is an abbreviation which means a mass of negative and big numbers". As the aforementioned parameters are used, the fuzzy reasoning rule (1), for example, describes "If A(i) is NS and B(i) is PS and C(i) is ZO, then $\Delta\alpha(i)$ is ZO". In the illustrated embodiment, there are prepared 74 fuzzy control rules in addition to the above rule (1) and the 75 rules are totally prepared. It should be noted that various parameters such as operating methods of experts are referred to in preparation of the control rules and that unnecessary rules can be properly omitted. For example, the following tables I(A), I(B), and I(C) illustrate rule tables of adjusting amount of control output when C(i) is zero, PS, and PB, respectively.

TABLE I (A)

| (Ci = Zero) | | Variation Amount B (i) PB | PS | ZO | NS | NB |
|---|---|---|---|---|---|---|
| Deviation A (i) | PB | PB | PB | PB | PS | PS |
| | PS | PB | PS | PS | ZO | ZO |
| | ZO | PB | PS | ZO | NS | NB |
| | NS | ZO | ZO | NS | NS | NB |
| | NB | NS | NS | NB | NB | NB |

TABLE I (B)

| (Ci = PS) | | Variation Amount B (i) PB | PS | ZO | NS | NB |
|---|---|---|---|---|---|---|
| Deviation A (i) | PB | PB | PB | PB | PB | PS |
| | PS | PB | PB | PB | PS | ZO |
| | ZO | PB | PB | PS | ZO | NS |
| | NS | PS | PS | ZO | NS | NS |
| | NB | PS | ZO | NS | NS | NB |

TABLE I (C)

| (Ci = PB) | | Variation Amount B (i) PB | PS | ZO | NS | NB |
|---|---|---|---|---|---|---|
| Deviation A (i) | PB | PB | PB | PB | PB | PB |
| | PS | PB | PB | PB | PB | PS |
| | ZO | PB | PB | PB | PS | PS |
| | NS | PB | PB | PS | PS | ZO |
| | NB | PB | PS | PS | ZO | ZO |

The values of $\Delta\alpha(i)$ corresponding to the aforementioned PB through NB are expressed by the following table II.

TABLE II

| | PB | PS | ZO | NS | NB |
|---|---|---|---|---|---|
| $\Delta\alpha$ (i) | 20 | 10 | 0 | −10 | −20 |

In the table II, $\Delta\alpha(i)$ has a unit of %. The adjusting amount $\Delta\alpha(i)$ of the coolant output $\alpha(i)$ is calculated by the fuzzy control rule table and is added to the former coolant output $\alpha\star(i)$ to determine the present coolant output $\alpha(i)$ as indicated by the following expression;

$$\alpha(i)=\alpha\star(i)+\Delta\alpha(i) \quad (4)$$

The spray pattern of the roll coolant is determined from the coolant output $\alpha(i)$ which is fed to the valve instruction means 36.

Figure 5:
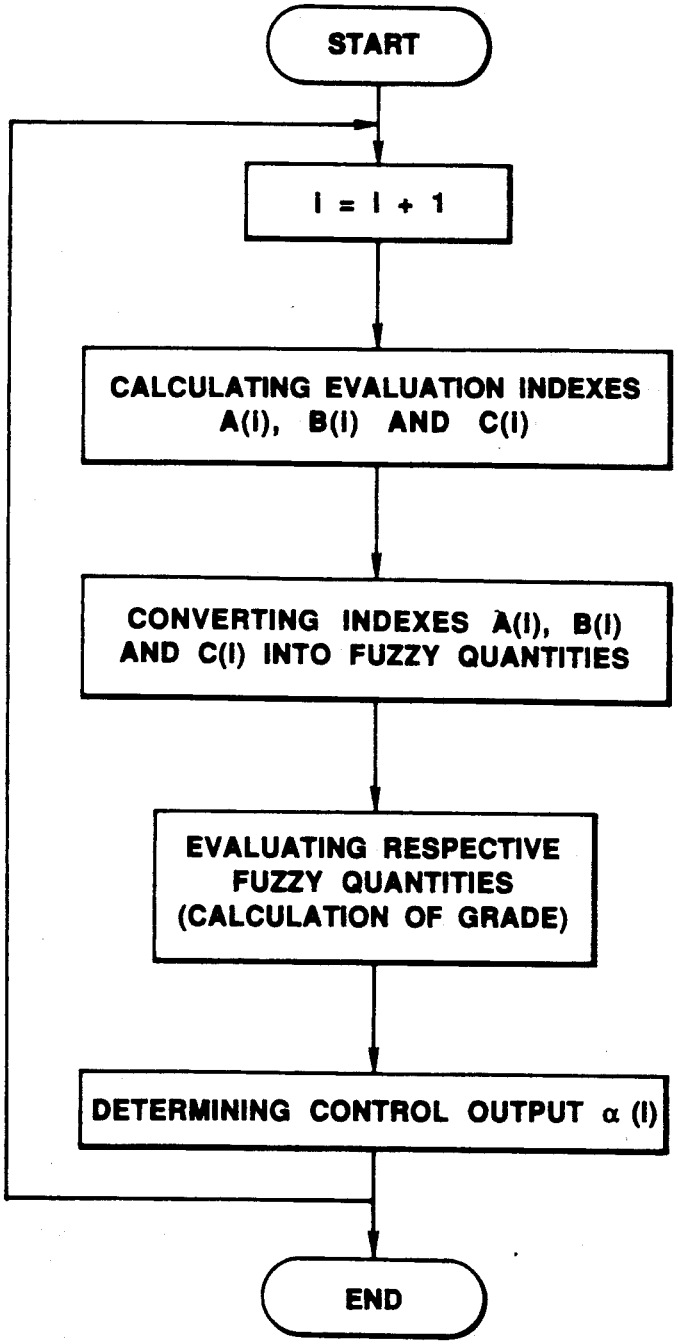
FIG. 5 is a flow chart in which the method of the invention is made in accordance with a computer.

FIG. 5 shows an example of a program in case of the coolant output calculation circuit 40 of FIG. 1 accomplished by a computer. This is actuated for a predetermined period such as one second, for example.

Although, in the illustrated embodiment, the spray pattern of roll coolant is determined by fuzzy reasoning using the three fuzzy quantities of deviation A(i) in relative difference in elongation, variation ratio B(i) in relative difference in elongation and localized buckle evaluation index C(i), at least two of the three fuzzy quantities may be combined. Furthermore, additional evaluation index or indexes may be used as fuzzy quantity or quantities in accordance with its object or objects. Although, in the illustrated embodiment, fuzzy control is made using one input (relative difference in elongation) and one output (coolant output), it may be made using multi-input (relative difference in elongation and another or other sensor input or inputs) and multi-output (coolant output and another or other acutator output or outputs).

Figure 6:
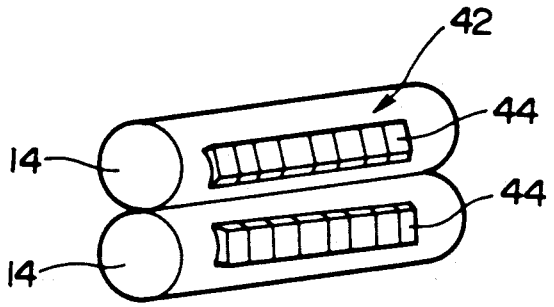
FIG. 6 perspectively illustrates in a brief manner work rolls having another actuator used for another embodiment of the invention.
Figure 7:
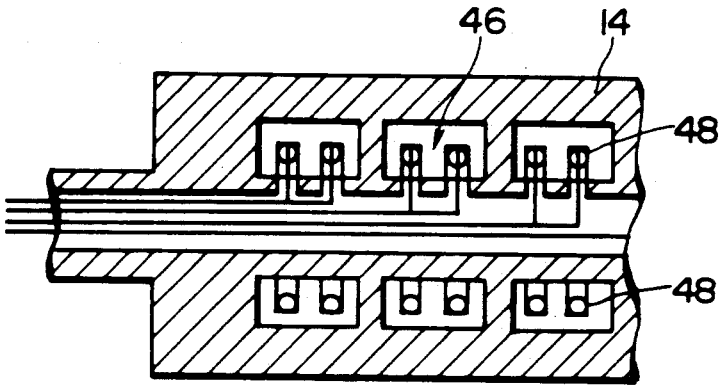
FIG. 7 illustrates in cross-sectional view work rolls having a further actuator used for a further embodiment of the invention.

FIGS. 6 and 7 illustrate modifications of the actuator used for the invention.

The actuator of FIG. 6 comprises outer heating means 42 including a plurality of outer heating elements 44 such as induction heating coils or high frequency heating elements disposed side by side in a longitudinal direction of the work rolls 14 so that they heat the corresponding zones of the work rolls 14 through the outer surfaces thereof. The control output obtained by fuzzy reasoning is applied to the outer heating means 42 so that the shapes or conditions of the work roll surfaces can be controlled whereby the flatness of the strip 12 is properly controlled.

The actuator of FIG. 7 comprises inner heating means 46 including a plurality of inner heating elements 48 such as induction heating coils, high frequency heating elements, electric heating elements and steam flowing conduits, for example disposed within the work rolls in a manner spaced from each other in a longitudinal direction of the work rolls 14 so that a plurality of divided heating zones are formed along the work rolls 14. The control output obtained by fuzzy reasoning is applied to the inner heating elements 48 so that the shapes or conditions of the the work roll surfaces can be controlled whereby the flatness of the strip is properly controlled. It will be noted that the inner heating means 46 may be replaced by inner cooling means including a plurality of cooling elements such as coolant flowing conduits disposed within the work rolls 14 in a manner spaced from each other in a longitudinal direction of the work rolls 14. A principle of operation of the inner cooling means is identical to that of the inner heating means 46.

Figure 8:
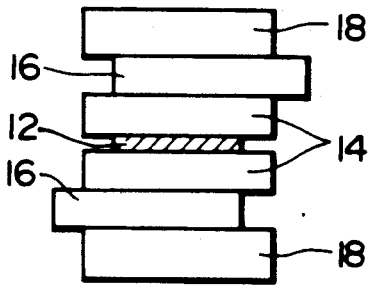
FIG. 8 illustrates in a front view roll means being controlled in accordance with another embodiment of the invention.
Figure 9:
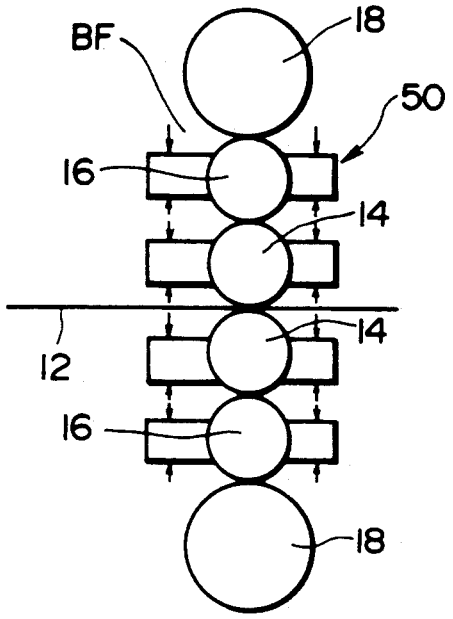
FIG. 9 illustrates in a side elevational view roll means being controlled in accordance with a further embodiment of the invention.
Figure 10:
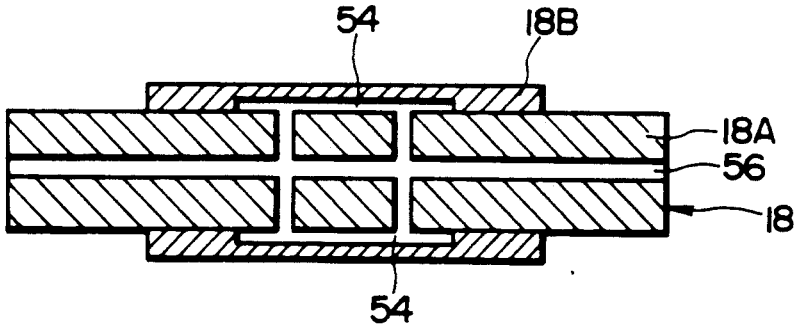
FIG. 10 illustrates in cross-sectional view a back up roll used for another embodiment of the invention.

FIGS. 8 through 10 illustrate three further modifications of the invention different from each other.

In the modification of FIG. 8, flatness control is made by longitudinal shift of either or both of the intermediate rolls 16 and the work rolls 14. Thus, it will be noted that the actuator of the modification of FIG. 8 will comprise shift means (not shown) to move the intermediate or work rolls 16 or 14. The control output obtained by fuzzy reasoning is applied to the shift means so that the shapes or conditions of the work roll surfaces can be controlled whereby the flatness of the strip is properly controlled.

In the modification of FIG. 9, flatness control is made by longitudinal bend of either or both of the intermediate rolls 16 and the work rolls 14. Thus, it will be noted that the acutuator of the modification of FIG. 9 will comprise bending means 50 to apply a bending force BF to the intermediate or work rolls 16 or 14. The control output obtained by fuzzy reasoning is applied to the bending means so that the shapes or conditions of the work roll surfaces can be controlled whereby the flatness of the strip is properly controlled. It should be noted that the bending means 50 may have a plurality of bending elements disposed in a divided manner along a longitudinal direction of the rolls 14 or 16 so that zone control of flatness can be made.

In the modification of FIG. 10, flatness control is made by variation in crown of at least one of the back up rolls 18, the intermediate rolls 16 and the work rolls 14. Thus, it will be noted that the actuator of the modification of FIG. 10 will comprise crown variation means to vary the crown of the rolls 14, 16 or 18. The control output obtained by fuzzy reasoning is applied to the crown variation means so that the shapes or conditions of the work roll surfaces can be controlled whereby the flatness of the strip is properly controlled. In the modification of FIG. 10, the back up rolls 18 have the crown variation means which may comprise oil filling spaces 54 provided in the back up rolls 18. In the illustrated embodiment, the back up roll 18 may be formed of a roll body 18A and a sleeve 18B provided on the roll body 18A and the oil filling spaces 54 are provided in the sleeve 18B at its inner face. An oil introduction passage 56 may be provided in the roll body 18A so that it communicates with the oil filling spaces 54. The crown can vary in accordance with an amount of oil filled in the spaces 54.

Thus, it will be noted that the actuator for controlling the shapes or conditions of the work roll surfaces may be in various forms so long as the flatness of the strip can be controlled along the width thereof.

Although, in the illustrated embodiments, only one actuator for controlling the shapes or conditions of the work roll surfaces is used, it will be noted by those skilled in the art that two or more than two actuators to be operated by fuzzy control may be used for controlling the shapes and/or conditions of the work woll surfaces. Roll cooling means and bending means, for example, may be combined and operated by fuzzy control.

While some preferred embodiments of the invention have been illustrated and described with reference to the accompanying drawings, it will be understood by those skilled in the art that they are by way of examples, and that various changes and modifications may be made without departing from the spirit and scope of the invention, which is intended to be defined only by the appended claims.

What is claimed is:

1. A method of controlling flatness of strip by rolling mill comprising an actuator for controlling shapes or conditions of work roll surfaces during rolling and a flatness meter for detecting broadwise flatness of rolled strip to generate an output signal whereby said actuator is operated so as to control the flatness of said strip in accordance with a plurality of evaluation indexes which are produced by analyzing said output signal, said method comprising the steps of:

converting said plurality of evaluation indexes into a qualitative language information;

determining from said qualitative language information a degree necessary for controlling said actuator by using a rule described in a language which is a qualitative model;

and converting said degree which is a language information into a control quantity whereby the flatness of said strip is controlled.

2. A method of controlling flatness of strip by a rolling mill as set forth in claim 1, wherein said actuator comprises outer roll cooling means including a plurality of coolant spray nozzles disposed side by side in a longitudinal direction of said work rolls so that coolant is sprayed onto said work rolls at their divided zones.

3. A method of controlling flatness of strip by a rolling mill as set forth in claim 1, wherein said actuator comprises outer roll heating means including a plurality of outer heating elements disposed side by side in a longitudinal direction of said work rolls so that said work rolls at their divided zones are heated by said respective outer heating means.

4. A method of controlling flatness of strip by a rolling mill as set forth in claim 1, wherein said actuator comprises inner roll heating means including a plurality of inner heating elements disposed within said work rolls in a manner spaced from each other in a longitudinal direction of said work rolls so that said work rolls at their divided zones are heated by said respective inner heating means.

5. A method of controlling flatness of strip by a rolling mill as set forth in claim 1, wherein said actuator comprises inner roll cooling means including a plurality of inner cooling elements disposed within said work rolls in a manner spaced from each other in a longitudinal direction of said work rolls so that said work rolls at their divided zones are cooled by said respective inner cooling elements.

6. A method of controlling flatness of strip by a rolling mill as set forth in claim 1, wherein said rolling mill has intermediate rolls and back up rolls in addition to said work rolls and flatness control of said strip is made by shifting at least one of said intermediate and back up rolls in accordance with said control output determined by said fuzzy reasoning.

7. A method of controlling flatness of strip by a rolling mill as set forth in claim 1, wherein said rolling mill has intermediate rolls and back up rolls in addition to said work rolls and flatness control of said strip is made by bending at least one of said intermediate and work rolls in accordance with said control output determined by said fuzzy reasoning.

8. A method of controlling flatness of strip by a rolling mill as set forth in claim 7, and wherein said flatness control of said strip is made at divided zones of said rolls.

9. A method of controlling flatness of strip by a rolling mill as set forth in claim 1, wherein said rolling mill has intermediate rolls and back up rolls in addition to said work rolls and wherein flatness control of said strip is made by varying the crown of at least one of said work, intermediate and back up rolls in accordance with said control output determined by said fuzzy reasoning.

10. A method of controlling flatness of strip by a rolling mill comprising an actuator for controlling shapes or conditions of work roll surfaces during rolling and a flatness meter for detecting broadwise flatness of rolled strip to generate an output signal whereby said actuator is operated so as to control the flatness of said strip in accordance with a plurality of evaluation indexes which are produced by analyzing said output signal, said method comprising the steps of:

said evaluation indexes including at least localized buckle evaluation index which is indicated by a difference between elongation at a first position and elongation at a second position adjacent to said first position in a longitudinal direction of said work rolls;

converting said plurality of evaluation indexes into a qualitative language information;

determining from said qualitative language information a degree necessary for controlling said actuator by using a rule described in a language which is a qualitative model;

and converting said degree which is a language information into a control quantity whereby the flatness of said strip is controlled.

11. An apparatus for controlling flatness of strip by a rolling mill comprising an actuator for controlling shapes or conditions of work roll surfaces during rolling and a flatness meter for detecting broadwise flatness of rolled strip to generate an output signal whereby said actuator is operated so as to control the flatness of said strip in accordance with a plurality of evaluation indexes which are produced by analyzing said output signal, said apparatus further comprising:

means to convert said plurality of evaluation indexes into a qualitative language information;

means to determine from said qualitative language information a degree necessary for controlling said actuator by using a rule described in a language which is a qualitative model;

and means to convert said degree which is a language information into a control quantity whereby the flatness of said strip is controlled.

12. An apparatus for controlling flatness of strip by a rolling mill as set forth in claim 11, wherein said actuator comprises outer roll cooling means including a plurality of coolant spray nozzles disposed side by side in a longitudinal direction of said work rolls so that coolant is sprayed onto said work rolls at their divided zones.

13. An apparatus for controlling flatness of strip by a rolling mill as set forth in claim 11, wherein said actuator comprises outer roll heating means including a plurality of outer heating elements disposed side by side in a longitudinal direction of said work rolls so that said work rolls at their divided zones are heated by said respective outer heating elements.

14. An apparatus for controlling flatness of strip by a rolling mill as set forth in claim 11, wherein said actuator comprises inner roll heating means including a plurality of inner heating elements disposed within said work rolls in a manner spaced from each other in a longitudinal direction of said work rolls so that said work rolls at their divided zones are heated by said respective inner heating elements.

15. An apparatus for controlling flatness of strip by a rolling mill as set forth in claim 11, wherein said actuator comprises inner roll cooling means including a plurality of inner cooling elements disposed within said work rolls in a manner spaced from each other in a longitudinal direction of said work rolls so that said work rolls at their divided zones are cooled by said respective inner cooling elements.

16. An apparatus for controlling flatness of strip by a rolling mill as set forth in claim 11, wherein said rolling mill has intermediate rolls and back up rolls in addition to said work rolls and wherein said actuator comprises shift means to shift at least one of said intermediate and work rolls in accordance with said control output determined by said fuzzy reasoning.

17. An apparatus for controlling flatness of strip by a rolling mill as set forth in claim 11, wherein said rolling mill has intermediate rolls and back up rolls in addition to said work rolls and wherein said actuator comprises bending means to bend at least one of said intermediate and work rolls in accordance with said control output determined by said fuzzy reasoning.

18. An apparatus for controlling flatness of strip by a rolling mill as set forth in claim 17, wherein said flatness control of said strip is made at divided zones of said rolls.

19. An apparatus for controlling flatness of strip by a rolling mill as set forth in claim 11, wherein said rolling mill has intermediate rolls and back up rolls in addition to said work rolls and wherein said actuator comprises means to vary the crown of at least one of said work, intermediate and back up rolls in accordance with said control output determined by said fuzzy reasoning.

20. An apparatus for controlling flatness of strip by a rolling mill comprising an actuator for controlling shapes or conditions of work roll surfaces during rolling and a flatness meter for detecting broadwise flatness of rolled strip to generate an output signal whereby said actuator is operated so as to control the flatness of said strip in accordance with a plurality of evaluation indexes which are produced by analyzing said output signal, said apparatus comprising:

said evaluation indexes including at least localized buckle evaluation index which is indicated by a difference between elongation at a first position and elongation at a second position adjacent to said first position in a longitudinal direction of said work rolls;

means to convert said plurality of evaluation indexes into a qualitative language information;

means to determine from said qualitative language information a degree necessary for controlling said actuator by using a rule described in a language which is a qualitative model;

and means to convert said degree which is a language information into a control quantity whereby the flatness of said strip is controlled.

* * * * *

UNITED STATES PATENT AND TRADEMARK OFFICE

CERTIFICATE OF CORRECTION

PATENT NO. : 5,235,835

DATED : August 17, 1993

INVENTOR(S) : Toshio Sakai et al

It is certified that error appears in the above-indentified patent and that said Letters Patent is hereby corrected as shown below:

Column 4, line 36, delete "function" and insert --functions--.

Signed and Sealed this

Twenty-eighth Day of June, 1994

*Attest:*

Bruce Lehman

BRUCE LEHMAN

*Attesting Officer*

*Commissioner of Patents and Trademarks*